US006519882B1

(12) United States Patent
Shuen

(10) Patent No.: US 6,519,882 B1
(45) Date of Patent: Feb. 18, 2003

(54) LICENSE PLATE FRAME STRUCTURE WITH KNOCKDOWN DECORATIVE ARTICLES

(75) Inventor: Shun-Tian Shuen, San Chung (TW)

(73) Assignee: Janchy Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/717,203

(22) Filed: Nov. 22, 2000

(51) Int. Cl.[7] ..... G09F 7/00
(52) U.S. Cl. ..... 40/209; 40/200
(58) Field of Search ..... 40/200, 201, 202, 40/209, 799; D12/193

(56) References Cited

U.S. PATENT DOCUMENTS 1,851,917 A * 3/1932 Maggio ..... 40/799
2,103,743 A * 12/1937 Doty ..... 40/202 X
2,178,727 A * 11/1939 Owens ..... 40/202 X
2,591,565 A * 4/1952 Linnard ..... 40/799 X
3,722,121 A * 3/1973 Olczewski ..... 40/799
5,381,618 A * 1/1995 Singleton ..... 40/209 X

FOREIGN PATENT DOCUMENTS

FR 1006910 * 4/1952 ..... 40/799

* cited by examiner

*Primary Examiner*—Brian K. Green
(74) *Attorney, Agent, or Firm*—Bacon & Thomas, PLLC

(57) ABSTRACT

License plate frame structure with knockdown decorative articles for shading the screws for locking the license plate frame. The license plate frame structure includes a license plate frame and multiple decorative articles. The license plate frame body is formed with several locating holes in each of which a locating plate is locked. Each of the decorative articles is composed of a decorative cover and a pivot plate locked on inner face of the decorative cover. The pivot plate is such connected with the locating plate that the decorative cover is permitted to be turned and opened within a certain range of angle and locked with and located on the license plate frame. The decorative articles can be easily replaced without being damaged. Also, the decorative articles are designed with various patterns to shade the pivot plate and locating plate and achieve a decorative and beautifying effect.

3 Claims, 8 Drawing Sheets

LICENSE PLATE FRAME STRUCTURE WITH KNOCKDOWN DECORATIVE ARTICLES

BACKGROUND OF THE INVENTION

The present invention relates to a license plate frame structure with knockdown decorative articles. The license plate frame structure includes multiple decorative articles which are locked with and located on the license plate frame. The decorative articles are easily replaceable and are designed with various patterns to achieve a decorative and beautifying effect.

A conventional license plate frame is formed with locating holes on four corners. Screws are screwed into the locating holes for locking the license plate frame. The screws are exposed to sunlight and rain so that after a long period of use, the screws are subject to rusting to deteriorate the appearance of the license plate frame. Some manufacturers have developed a cap structure which is plugged into the locating hole of the license plate frame so as to shade the screw.

However, such cap member has some shortcomings as follows:

1. It is troublesome and laborious to replace the license plate frame. The cap member is tightly fitted into the locating hole for shading the screw. When prying the cap member for disassembling or replacing the license plate frame, the locating hole and the cap member tend to be damaged. Moreover, it is quite troublesome and laborious to pry the cap member.
2. The cap member is a substantially elliptic cap body which has monotonous appearance and lacks any other function.

SUMMARY OF THE INVENTION

It is therefore a primary object of the present invention to provide a license plate frame structure with knockdown decorative articles which can be easily and conveniently replaced without being damaged. The decorative articles are designed with various patterns to achieve a decorative and beautifying effect.

According to the above object, the license plate frame structure with knockdown decorative articles of the present invention serves to shade the screws for locking the license plate frame. The license plate frame structure includes a license plate frame and multiple decorative articles. The license plate frame body is formed with several locating holes in each of which a locating plate is locked. Each of the decorative articles is composed of a decorative cover and a pivot plate locked on inner face of the decorative cover. The pivot plate is such connected with the locating plate that the decorative cover is permitted to be turned and opened within a certain range of angle and locked with and located on the license plate frame. The decorative articles can be easily replaced without being damaged. Also, the decorative articles are designed with various patterns to shade the pivot plate and locating plate and achieve a decorative and beautifying effect The present invention can be best understood through the following description and accompanying drawings wherein:

DETAILED DESCRIPTION OF THE PREFERRED EMBODIMENTS

Figure 1:
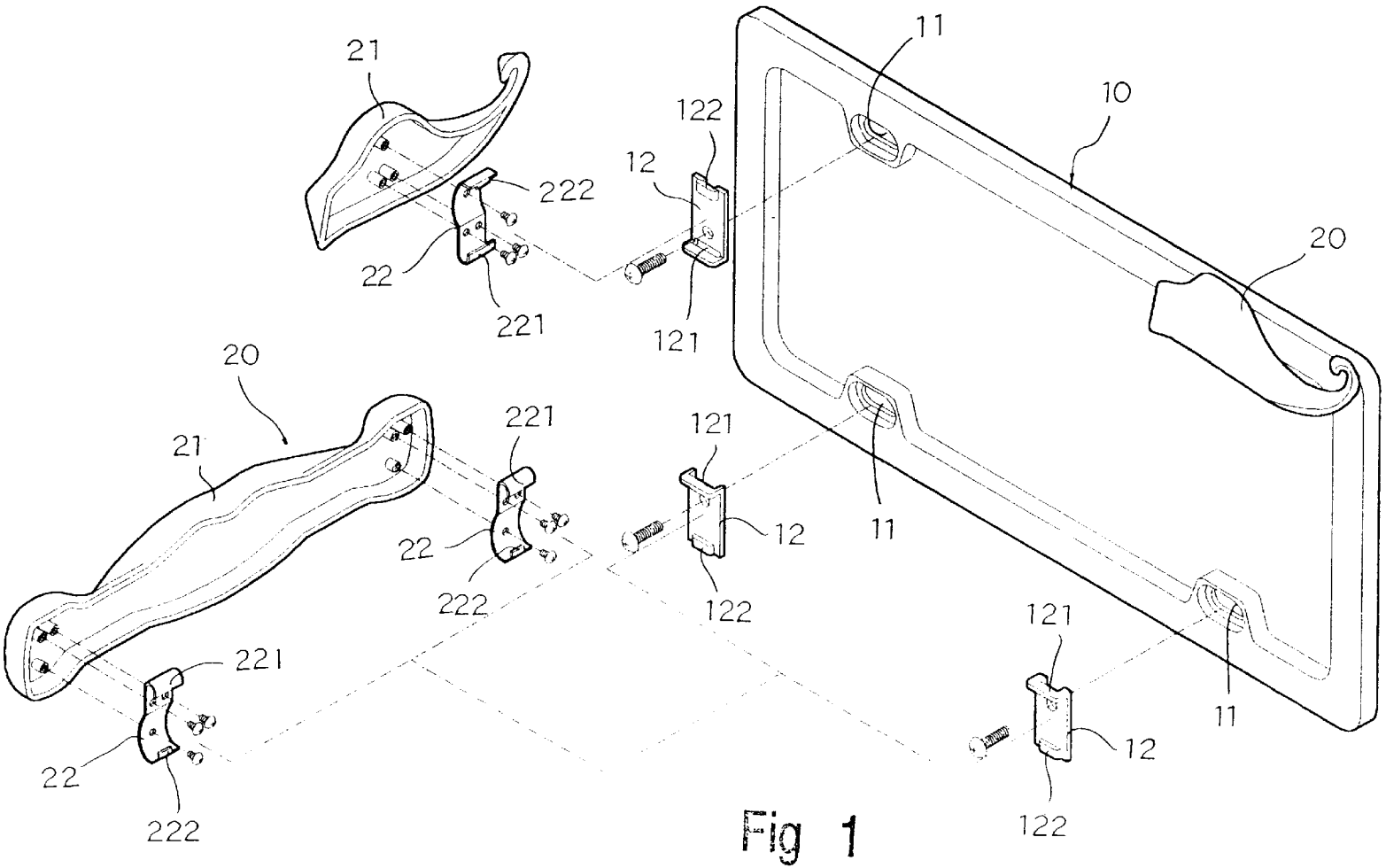
FIG. 1 is a perspective exploded view of a first embodiment of the present invention.
Figure 2:
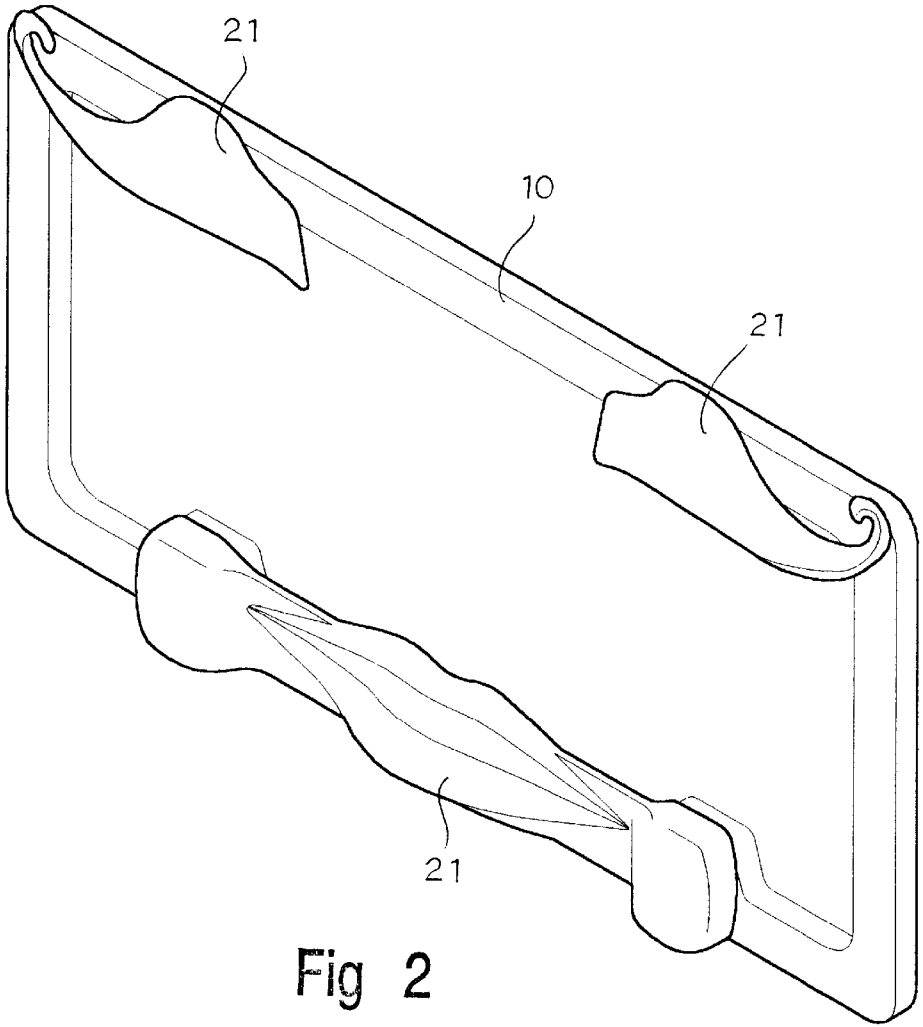
FIG. 2 is a perspective assembled view of the first embodiment of the present invention.

Please refer to FIGS. 1 and 2. The license plate frame structure of the present invention includes a license plate frame 10 and multiple decorative articles 20.

The license plate frame 10 is a hollow rectangular frame body similar to a conventional one. The inner side of the frame body is formed with several locating holes 11 in each of which a locating plate 12 is locked by a screw. The locating plate 12 has a connecting end 121 and a hooking end 122.

The decorative article 20 is composed of a decorative cover 21 and a pivot plate 22. The decorative cover 21 is freely formed with predetermined pattern. The pivot plate 22 is locked on inner face of the decorative cover 21. One end of the pivot plate 22 is formed with at arch hooking section 221, while the other end thereof is formed with a latch section 222. The hooking section 221 cooperates with the connecting end 121, permitting the decorative cover 21 to be turned and opened within a certain range of angle. The latch section 222 can be latched with the hooking end 122 to locate the decorative cover 21 on the license plate frame 10.

Figure 3:
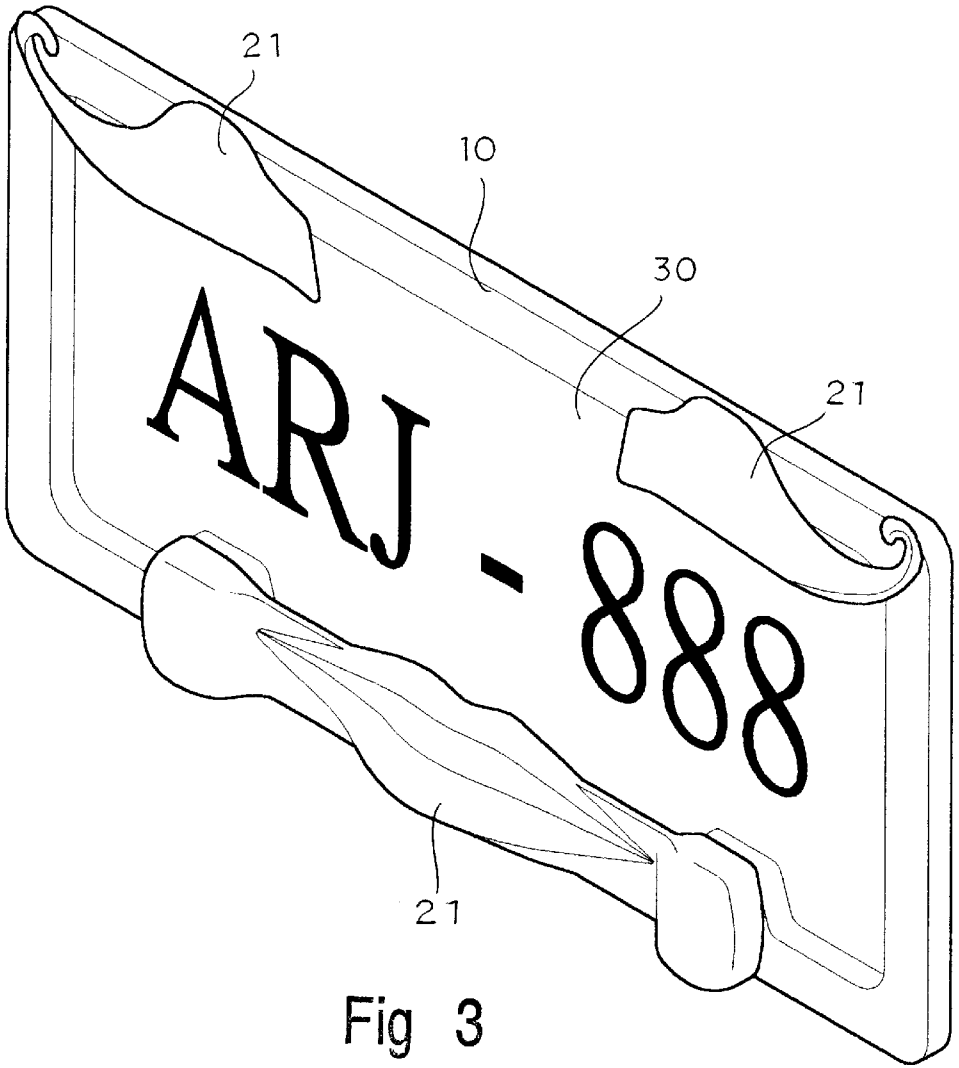
FIG. 3 shows the application of the first embodiment of the present invention to a license plate.
Figure 4:
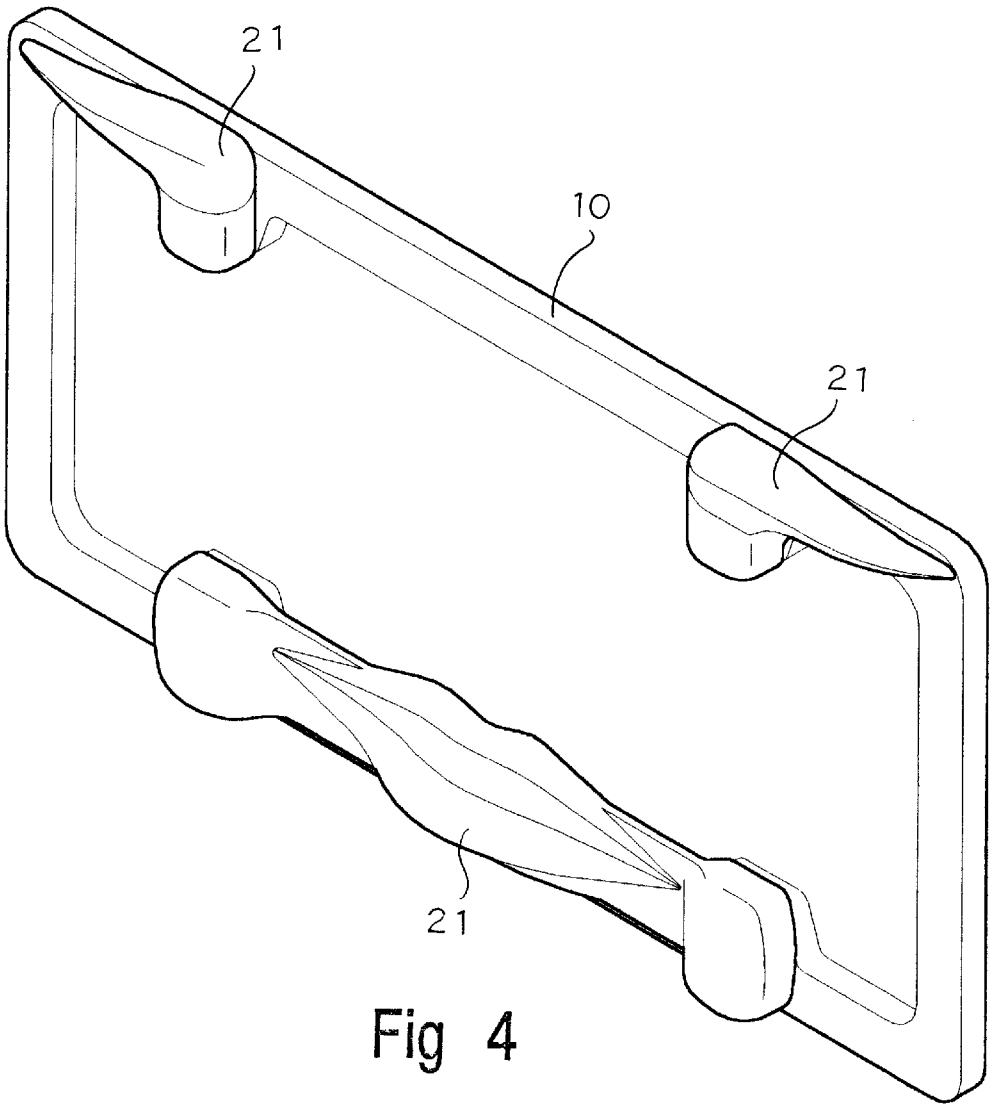
FIG. 4 shows another embodiment of the present invention.
Figure 5:
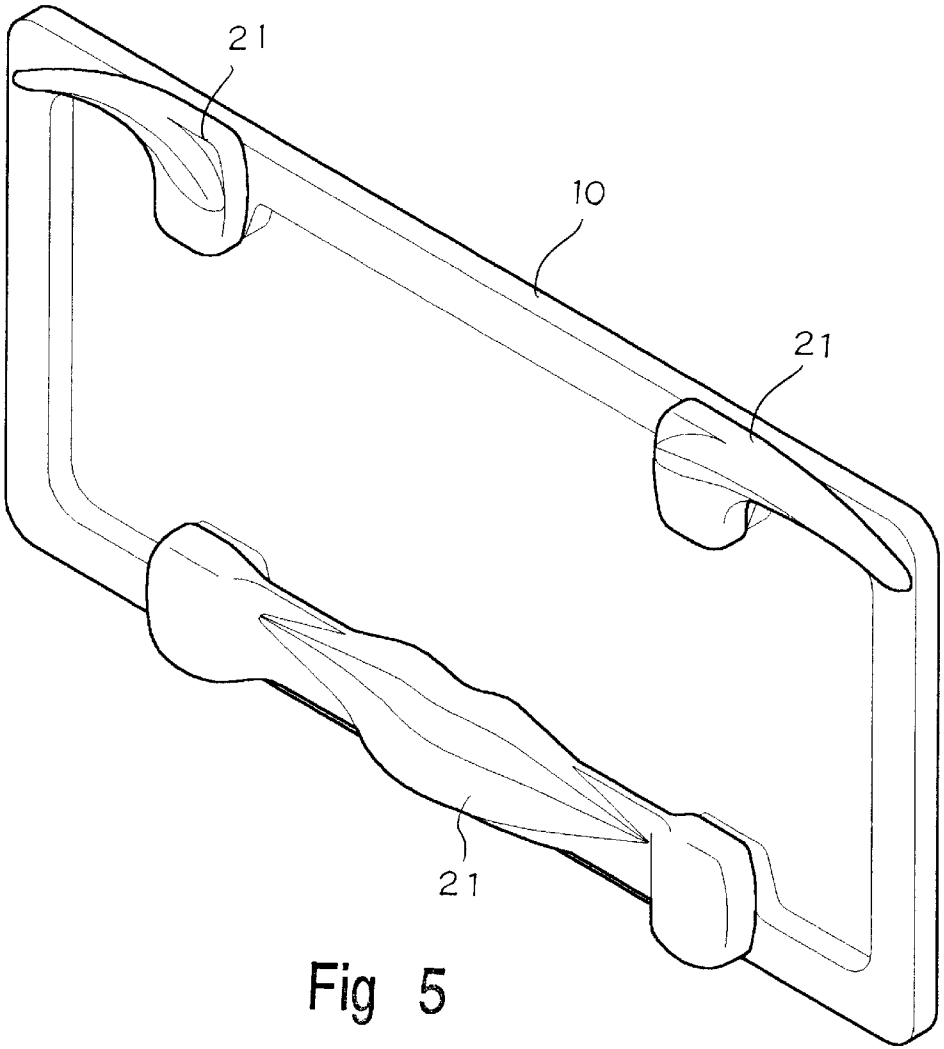
FIG. 5 shows still another embodiment of the present invention.
Figure 6:
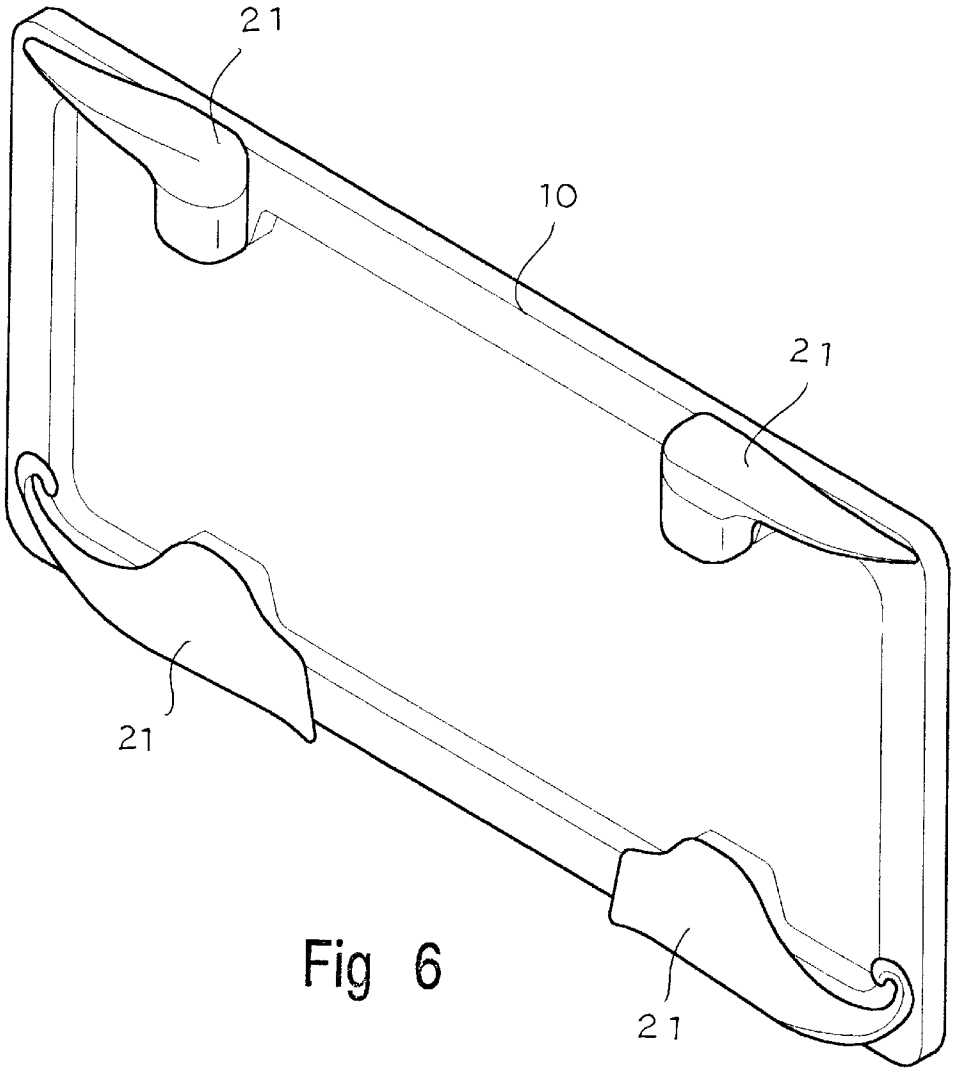
FIG. 6 shows still another embodiment of the present invention.
Figure 7:
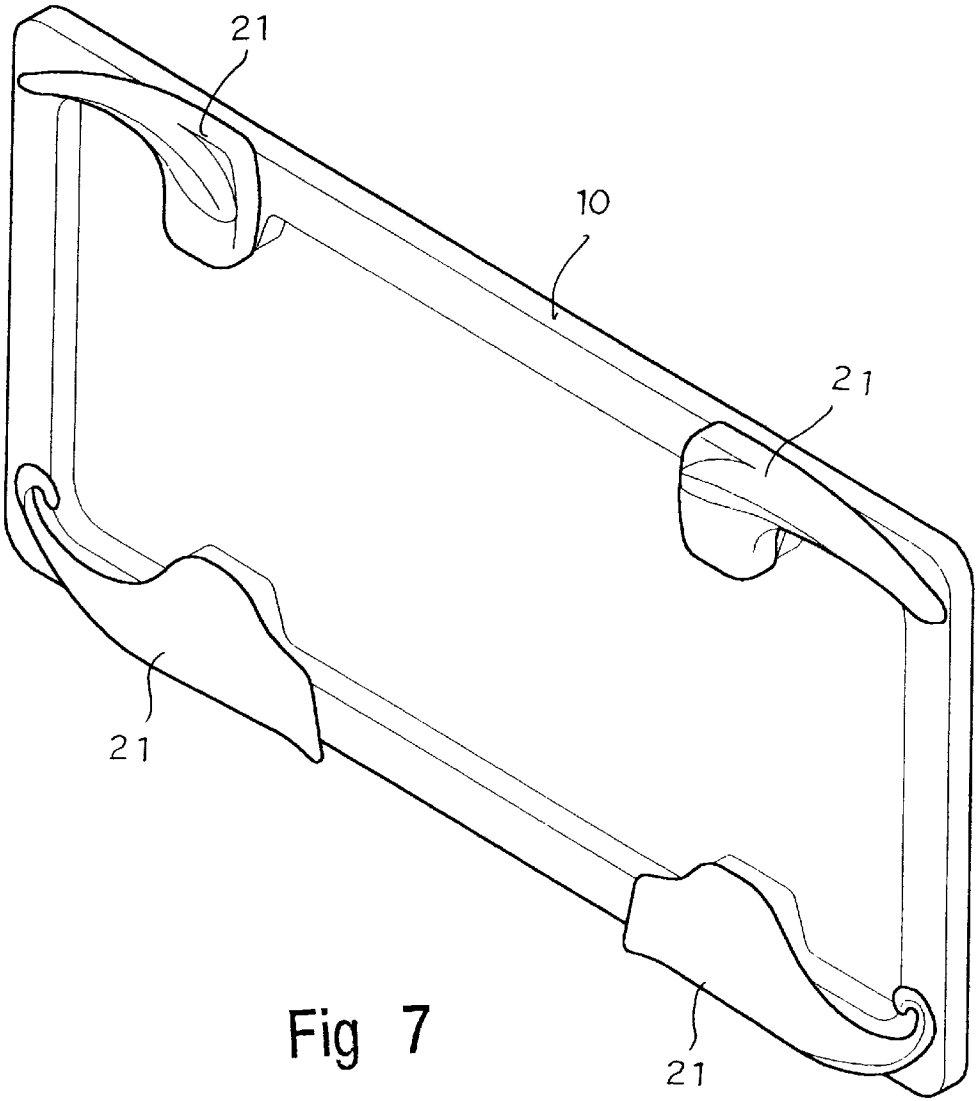
FIG. 7 shows still another embodiment of the present invention.

In use, the license plate frame 10 is first locked with the license plate 30 of a general car or motorcycle. Then the multiple decorative articles 20 are respectively fixed at the locating holes 11 of the license plate frame 10 to form a beautifying decorative license plate frame structure as shown in FIG. 3.

Please refer to FIGS. 4 to 7. The decorative articles 20 of the license plate frame structure of the present invention are limited to specific pattern. The decorative articles 20 can be freely designed With various live patterns to highlight personal styles and achieve a beautifying effect.

Figure 8:
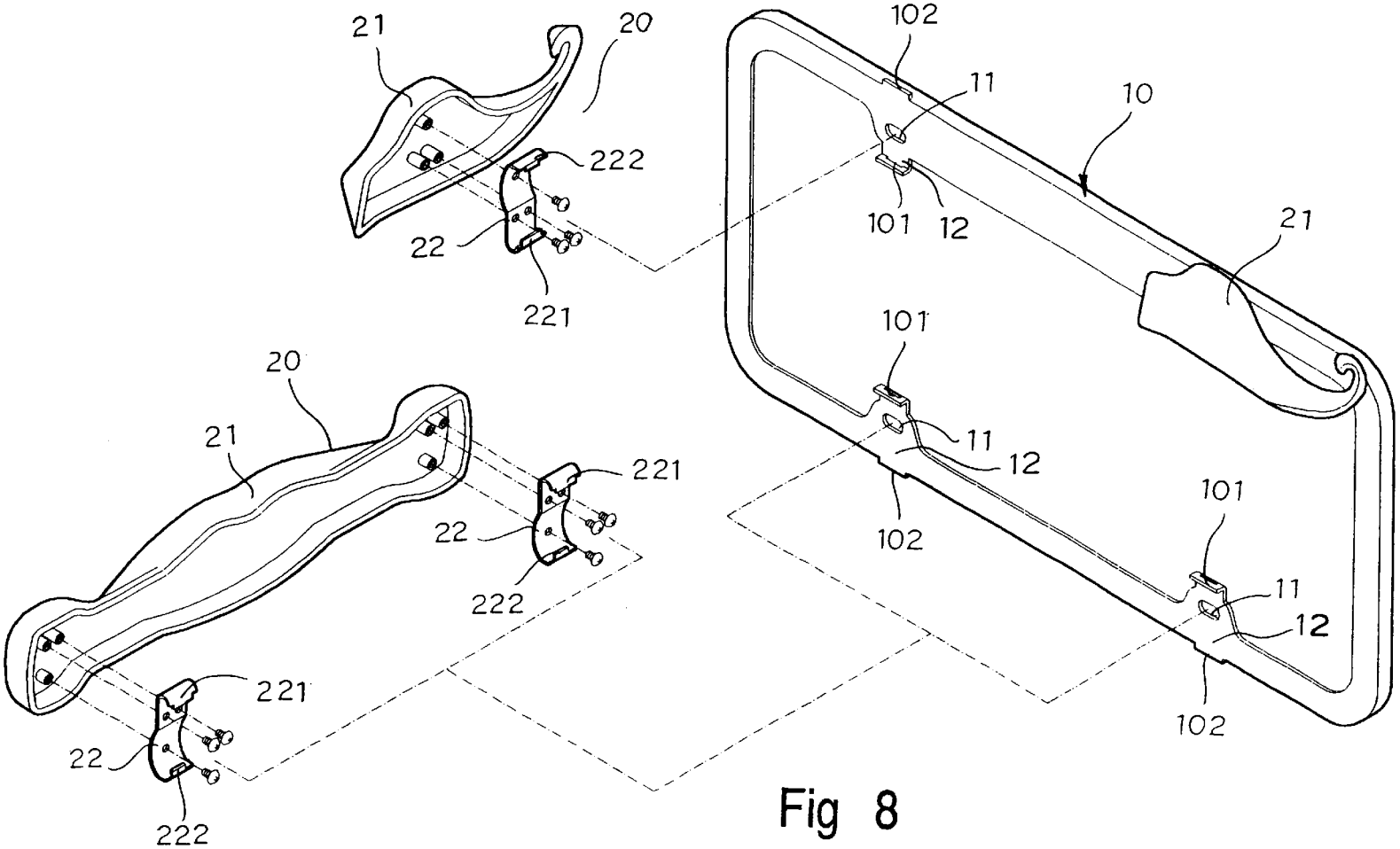
FIG. 8 shows still another embodiment of the present invention.

Furthermore, the decorative articles 20 can replace the license plate frame of a general car or motorcycle. As shown in FIG. 8, neither of the inner and outer sides of the locating hole 11 of the conventional license plate frame 10 has any hook section 101 and latch section 102. The locating plate 12 can be omitted by being integrally formed with the license plate frame 10 and the inner and outer sides of the locating hole 11 of the license plate frame 10 are formed with a hook section 101 and a latch section 102 for latching with the hook section 221 and latch section 222 of the pivot plate 22. The decorative cover 21 still can be turned and opened by means of the pivot plate 22. By means of the latch section 102 of the license plate frame 10, the license plate frame 10 can be closed and located.

According to the above arrangement, the present invention has the following advantages:

1. The various kinds of decorative articles are connected with the license plate frame by means of the pivot plate and the locating plate. The pivot plate is formed with hook section and latch section and the locating plate is formed with corresponding connecting end and hooking end for latching with the pivot plate. The pivot plate can be easily assembled with and disassembled from the locating plate so that it is easy to replace the decorative article with another.

2. The decorative articles of the present invention serve to shade the screws locked in the multiple locating holes of the license plate frame. In addition, the decorative articles can highlight personal style of a user and achieve a beautifying effect.

The above embodiments are only used to illustrate the present invention, not intended to limit the scope thereof. Many modifications of the above embodiments can be made without departing from the spirit of the present invention.

What is claimed is:

1. A license plate frame structure having knockdown decorative articles, comprising:

a license plate frame comprising a hollow rectangular frame body, an inner side of the frame body being formed with several locating holes;

a plurality of locating plates, each of the locating plates is locked onto corresponding ones of the locating holes by a screw; and a plurality of decorative articles each of which comprises a decorative cover and a pivot plate, the pivot plate being locked on an inner face of the decorative cover, the pivot plate being connected with the locating plate such that the pivot plate is detachably hinged to a respective locating plate.

2. The license plate frame structure with knockdown decorative articles as claimed in claim 1, wherein one end of each of the locating plates is a connecting end, while the other end of each of the locating plates is a hooking end.

3. The license plate frame structure with knockdown decorative articles as claimed in claim 1, wherein one end of each of the pivot plates is an arch hook section, while the other end of each of the pivot plates is a latch section.

* * * * *